US005728033A

United States Patent [19]

Rogers

[11] Patent Number: 5,728,033

[45] Date of Patent: Mar. 17, 1998

[54] SWIMMING SIMULATOR EXERCISE DEVICE

[75] Inventor: Thomas P. Rogers, Englewood, N.J.

[73] Assignee: RTOM Corporation, Englewood, N.J.

[21] Appl. No.: 48,270

[22] Filed: Apr. 14, 1993

[51] Int. Cl.[6] ..... A63B 21/008

[52] U.S. Cl. ..... 482/111; 482/113; 482/79

[58] Field of Search ..... 482/111, 112, 482/113, 79, 80, 55, 56, 108; 434/254

[56] References Cited

U.S. PATENT DOCUMENTS

| | | | |
|---|---|---|---|
| 3,529,474 | 9/1970 | Olson et al. . | |
| 4,146,222 | 3/1979 | Hribar | 482/112 |
| 4,222,560 | 9/1980 | Hallerman . | |
| 4,353,547 | 10/1982 | Jenkinson . | |
| 4,496,147 | 1/1985 | DeCloux et al. . | |
| 4,601,467 | 7/1986 | Gvoich et al. | 482/113 |
| 4,681,316 | 7/1987 | DeCloux . | |
| 4,685,666 | 8/1987 | DeCloux . | |
| 4,848,739 | 7/1989 | Schaub et al. | 482/113 |
| 4,854,577 | 8/1989 | Sims . | |
| 5,026,046 | 6/1991 | DeCloux . | |
| 5,186,700 | 2/1993 | Wang | 482/111 |

*Primary Examiner*—Lynne A. Reichard
*Attorney, Agent, or Firm*—Fish & Richardson P.C.

[57] ABSTRACT

Exercising apparatus includes a reservoir unit for receiving and dispensing fluid. An arm exercising unit includes at least two hollow paddles with fluid. Each of the hollow paddles may be connected to the reservoir unit by a flexible feedline and return line. A pump may pump fluid from the reservoir unit to each of said hollow paddles via said feedline. A return mechanism may allow flow of the fluid from the hollow paddles to the reservoir unit via the return line.

10 Claims, 1 Drawing Sheet

SWIMMING SIMULATOR EXERCISE DEVICE

The present invention relates in general to exercise equipment, and more particularly concerns novel apparatus and techniques for using an exercise device for muscle development, typically similar to that received through swimming.

A search of subclasses 53, 112, and 113 of class 482 uncovered U.S. Pat. Nos. 3,529,474; 4,222,506; 4,355,547; 4,496,147; 4,681,316; 4,685,666; 4,854,577; and 5,026,046, which furnish background for the invention.

According to the invention, an exercise device comprises a hollow paddle carrying fluid in a compartment therein. Preferably there are at least relatively movable two hollow paddles each connected by flexible dual-line hoses to a fluid-filled reservoir unit and movable relative to the reservior unit. Each dual-line hose has of a feed line and a return line of sufficient length to allow swinging movement relative to the reservior unit of the paddles by a user then receiving arm exercise. A pumping mechanism is provided to pump the fluid from the reservoir unit to each of the hollow paddles via the feed line. A return mechanism is provided for allowing flow of the fluid from each of the paddles to the reservoir unit via the return line.

In one embodiment, two depressible foot pads are attached to the reservoir unit. Each foot pad is also connected to the pumping mechanism in such a manner that depressing one of the foot pads forces fluid through the corresponding feed line and into the corresponding hollow paddle (i.e. depressing the left foot pad forces fluid through the left feed line and into the left hollow paddle).

According to one aspect of the invention, the paddle is swung behind the user's back rotating left to right or right to left. The user swings one paddle at a time. While swinging the paddles, the user's legs are also pumping up and down, thereby alternatively depressing each of the foot pads and pumping fluid through the feed lines into each of the paddles. According to another aspect of the invention, a release mechanism allows the user to increase the flow of fluid from the paddles to the reservoir unit via the return line.

Numerous other features, objects, and advantages of the invention will become apparent from the following detailed description when read in connection with the accompanying drawings.

Figure 1:
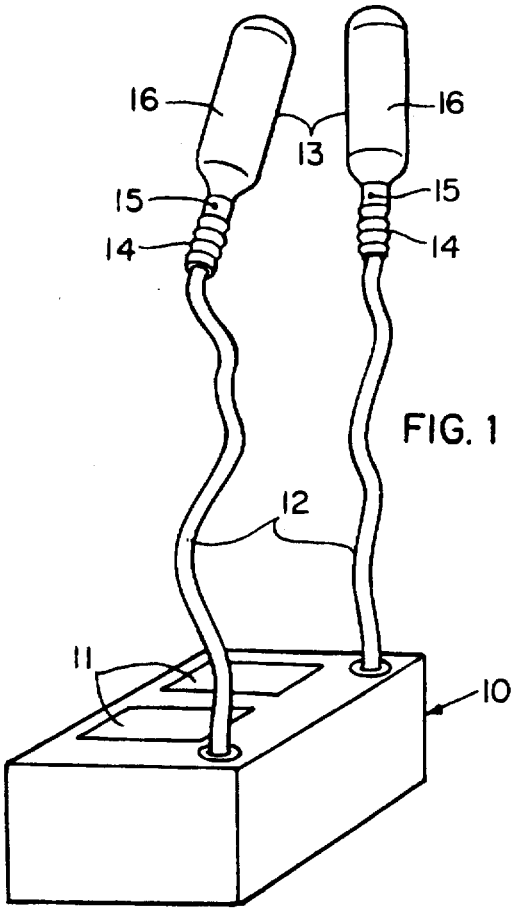
FIG. 1 is a perspective view of an embodiment of the invention.

With reference now to the drawings and more particularly to FIG. 1, there is shown a perspective view of an exemplary embodiment of the invention. Built into the reservoir unit 10 are two foot pads 11. Attached to the reservoir unit 10 are two flexible dual-line hoses 12, each of which are attached to a hollow paddle 13.

Figure 2:
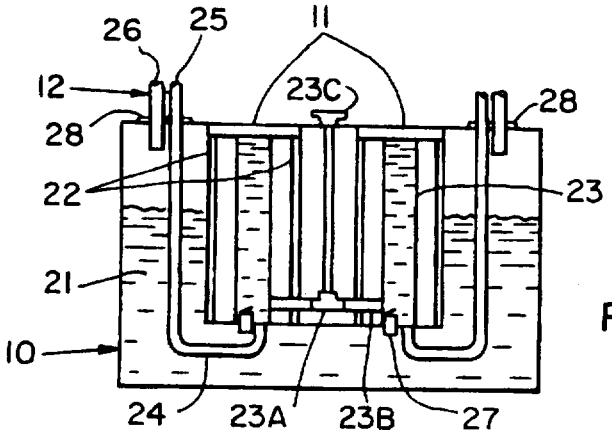
FIG. 2 is a cutaway elevation view of the reservoir unit showing the arrangement of components within the reservoir unit.

As shown in FIG. 2, reservoir unit 10 is filled with water 21. Each foot pad 11 travels in tracks 22 and is thereby limited to vertical motion. Each foot pad 11 is also connected to a compression chamber 23. Connected to openings in each compression chamber 23 are tube 24 and intake valve 27. Each tube 24 is also connected to a feed line 25 of a dual-line hose 12. Compression chambers 23 are interconnected by tube 23B having a valve 23A controlled by valve stem 23C to adjust interchamber flow that helps furnish a desired lifting force to the rising pedal when the other pedal is being depressed.

Figure 3:
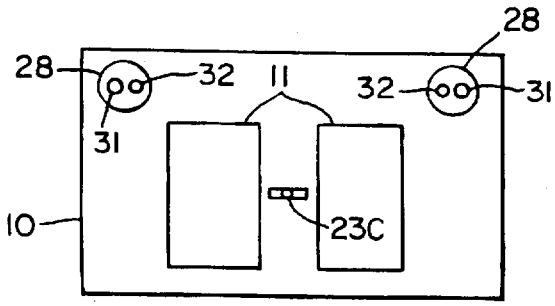
FIG. 3 is a top view of the reservoir unit.

Each dual-line hose 12 is connected to reservoir unit 10 via a hose connector 28. FIG. 3 shows each hose connector 28 located in a front corner on the top of reservoir unit 10. Each hose connector 28 includes orifices 31 and 32 connected, respectively, to return line 26 and feedline 25 of dual-line hose 12. To ensure that paddles 13 do not overfill, return line 26 and orifice 31 have larger diameters than feedline 25 and orifice 32.

In one embodiment, a user's feet are secured to foot pads 11 using special boots (not shown) affixed to foot pads 11. These boots are similar to those used with diving suits and consist of a stretchable material such as spandex rubber. A user's feet are secured in the boots by straps of hook and loop fasteners.

Figure 4:
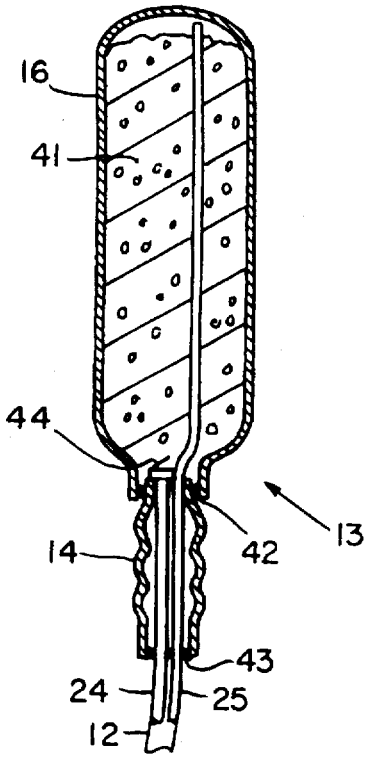
FIG. 4 is a cutaway view of a hollow paddle.

Referring to FIG. 4, each paddle 13 has a handle 14 connected to a rigid, hollow reservoir section 16. Hollow reservoir section 16 is filled with a spongelike material 41 to resist water movement.

Seals between handle 14 and both hollow reservoir section 16 and dual-line hose 12 are formed, respectively by gaskets 42 and 43.

A release button 15, shown in FIG. 1, is attached to each paddle 13 and operates valve 44.

Having described the physical arrangement of the system, its mode of operation will be described. Depressing foot pad 11 compresses compression chamber 23 and thereby pumps water through tube 24 and into feedline 25 of dual-line hose 12 while raising the other pad with the force transmitted through tube 23B. When pressure on foot pad 11 is released, compression chamber 23 decompresses and returns foot pad 11 to its normal position. As compression chamber 23 decompresses, water enters compression chamber 23 through intake valve 27. Intake valve 27 is a unidirectional valve to prevent outflow of water through intake valve 27 when compression chamber 23 is being compressed.

Water pumped through feedline 25 enters hollow reservoir section 16 of paddle 13. Water flows from hollow reservoir section 16 through valve 44, which is connected to return line 24 of dual-line hose 12. Water flowing through return line 24 drains into reservoir unit 10.

Valve 44 is partially open under normal operating conditions and can be fully opened by depressing release button 15. Thus, depressing release button 15 increases water flow from hollow reservoir section 16 and into reservoir unit 10, thereby reducing the water level in, and weight of, paddle 13. With valve 44 locked in the closed position, the user may operate the paddles independently of the foot unit.

Arm exercise is provided by a device comprising hollow paddles whose weight can be adjusted before or while exercising. Weight variation is achieved by pumping a fluid from, or releasing a fluid into, a reservoir unit. Alternatively, fluid may be added to or withdrawn from the paddles manually. Leg exercise is provided by a device consisting of depressible foot pads. Much of the arm and leg motion by a person using the invention is similar to that of swimming the back stroke.

The invention has a number of advantages. It provides a novel exercise device that simulates the muscle development obtained through swimming. It provides a resistive workout which requires a user to perform arm and leg motions similar to those made when swimming the back stroke.

The invention provides a convenient means of varying the difficulty of a workout at different places in the workout. Through the frequency of depressing the foot pads as well as use of the release buttons, the user has control over the amount of water in the paddles, and, therefore, the weight of the paddles. This, in turn, gives the user control over the difficulty of the upper body portion of the workout provided by the claimed invention. Likewise, the difficulty of the leg portion of the workout is mandated by the frequency at which the foot pads are depressed. Thus, the user has discretion to vary the difficulty of all aspects of the workout provided by the invention at any point in the workout.

Because the user is given so much control over the difficulty of the workout, the invention readily adapts for use by persons having varied levels of skill and endurance. A more skilled or robust user could, by vigorously depressing the foot pads and refraining from using the release buttons, obtain a strenuous workout, while a novice user could operate the foot pads at a slower pace and make frequent use of the release buttons to obtain a less strenuous workout. Similarly, with detached paddles, the paddles could be filled with much fluid for a strenuous workout and less fluid for a less strenuous workout.

Other embodiments are within the claims.

What is claimed is:

1. Exercising apparatus comprising:

a reservoir unit for receiving and dispensing fluid;

an arm exercising unit comprising at least two relatively movable paddles each having a compartment and movable relative to said reservoir unit, each of said compartments being connected to and separated from said reservoir unit by a flexible feedline and flexible return line wherein said flexible feedline is seperate from said flexible return line;

a pump for pumping fluid from said reservoir unit to each of said compartments via said feedline; and a return mechanism for allowing flow of said fluid from said compartments to said reservoir unit via said return line.

2. Apparatus in accordance with claim 1 and further comprising:

a leg exercising unit separated from said arm exercising unit comprising at least two foot pads, said foot pads being operatively connected to control the rate at which said pump pumps said fluid from said reservoir unit to said compartments.

3. Apparatus in accordance with claim 2 wherein said pump comprises a compression chamber connected to each of said foot pads so that depression of a foot pad compresses said compression chamber to pump said fluid.

4. A method of using the apparatus of claim 2 including, swinging said hollow paddles behind the user's back in rotating motion one at a time while depressing each of said foot pads with the user's legs to alternately depress each of said foot pads and pump fluid through said feedlines into each of said compartments.

5. Apparatus in accordance with claim 1 wherein said compartments are filled with a spongelike substance.

6. Apparatus in accordance with claim 5 wherein said spongelike substance is constructed and arranged to resist liquid movement in said compartment.

7. Apparatus in accordance with claim 1 wherein said return mechanism comprises a valve operated by a release button.

8. Apparatus in accordance with claim 1 wherein the diameter of said return line exceeds the diameter of said feedline.

9. Exercising apparatus comprising, a pair of relatively movable hollow paddles for furnishing arm exercise each having a controllable opening that admits and releases fluid, and fluid in each of said hollow paddles of an amount related to how strenuous a workout is desired by swinging said paddles with said fluid therein.

10. A method of using the apparatus of claim 9 including, swinging said hollow paddles one paddle at a time behind the user's back with rotating motion one paddle at a time.

* * * * *